US005376063A

United States Patent [19]

Greenstein

[11] Patent Number: 5,376,063

[45] Date of Patent: Dec. 27, 1994

[54] SELF-BALANCING APPARATUS AND METHOD FOR A CENTRIFUGE DEVICE

[75] Inventor: Alan P. Greenstein, Seattle, Wash.

[73] Assignee: Boehringer Mannheim Corporation, Indianapolis, Ind.

[21] Appl. No.: 19,575

[22] Filed: Feb. 18, 1993

Related U.S. Application Data

[62] Division of Ser. No. 645,106, Jan. 23, 1991, Pat. No. 5,207,634.

[51] Int. Cl.[5] ..... B04B 9/14

[52] U.S. Cl. ..... 494/37; 494/16; 494/82; 494/84; 73/470

[58] Field of Search ..... 494/1, 7, 10, 16, 37, 494/82, 84; 73/462, 4, 68, 470; 74/573 R; 364/463, 508

[56] References Cited

U.S. PATENT DOCUMENTS

| | | | |
|---|---|---|---|
| 2,895,766 | 7/1959 | Leopold, Jr. . | |
| 2,958,165 | 11/1960 | Hofmann | 74/573 R |
| 3,679,130 | 7/1972 | Mayo | 494/82 |
| 3,692,236 | 9/1972 | Livshitz | 74/573 R |
| 4,039,288 | 8/1977 | Moran . | |
| 4,117,742 | 10/1978 | Stein | 74/573 R |
| 4,238,960 | 12/1980 | Curtis et al. . | |
| 4,547,185 | 10/1985 | Hellekant | 494/82 |
| 4,700,117 | 10/1987 | Giebeler et al. . | |
| 4,711,610 | 12/1987 | Riehl | 74/573 R |
| 5,030,418 | 7/1991 | Miyata . | |

FOREIGN PATENT DOCUMENTS

| | | | |
|---|---|---|---|
| 2110116 | 5/1972 | France . | |
| 2908272 | 9/1980 | Germany . | |
| 3742149 | 6/1989 | Germany | 494/82 |
| 3742149A1 | 6/1989 | Germany . | |
| 672843A5 | 12/1989 | Switzerland . | |
| 1013784 | 4/1983 | U.S.S.R. | 73/468 |
| 1050753 | 10/1983 | U.S.S.R. . | |
| 1597642 | 10/1990 | U.S.S.R. | 74/573 R |

OTHER PUBLICATIONS

Schultz, Steven G. et al., "Two-Dimensional Desk-Top Clinical Chemistry," *Clinical Chemistry*. 31(9):1457–1463, 1985.

*Primary Examiner*—David A. Scherbel
*Assistant Examiner*—Randall E. Chin
*Attorney, Agent, or Firm*—Seed and Berry

[57] ABSTRACT

A self-balancing apparatus for a centrifuge is disclosed which employs two arcuately movable counterweights. The centrifuge has a plurality of receptacles for receiving one or more assay cartridges. Control apparatus in the centrifuge determines the location and number of received cartridges. Desired counterweight positions are then calculated which will substantially balance the centrifuge. The counterweights are moved into these positions prior to the centrifuge being operated at high speeds.

15 Claims, 5 Drawing Sheets

FIG. 1
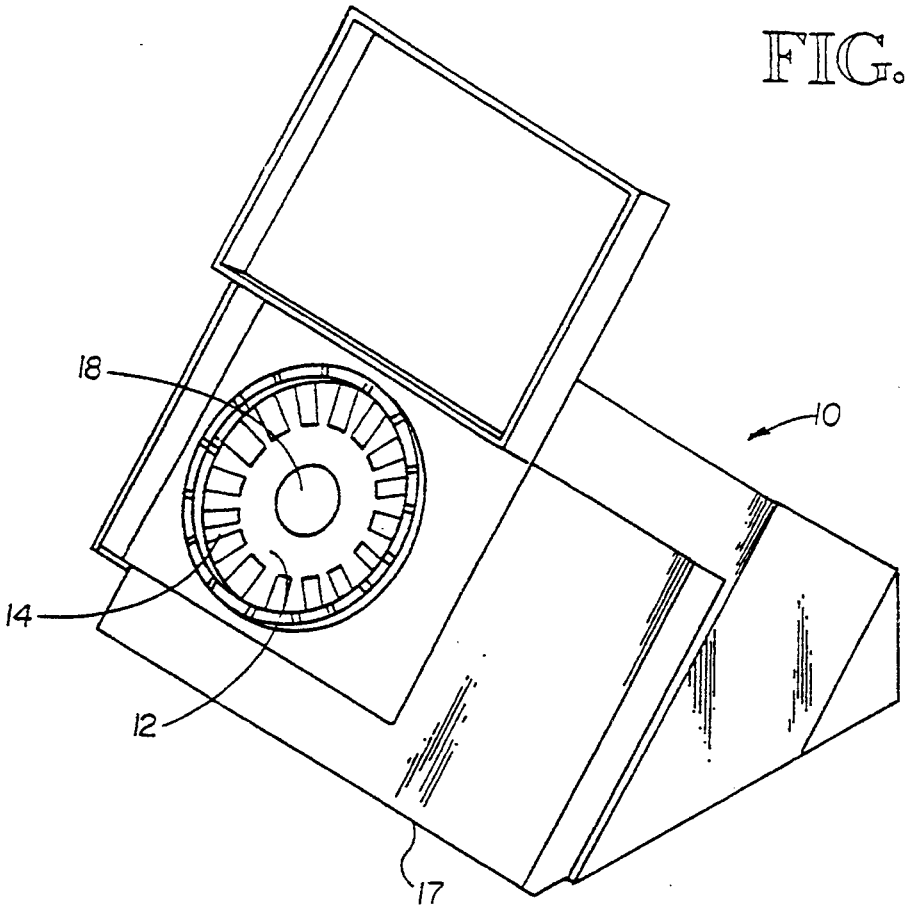
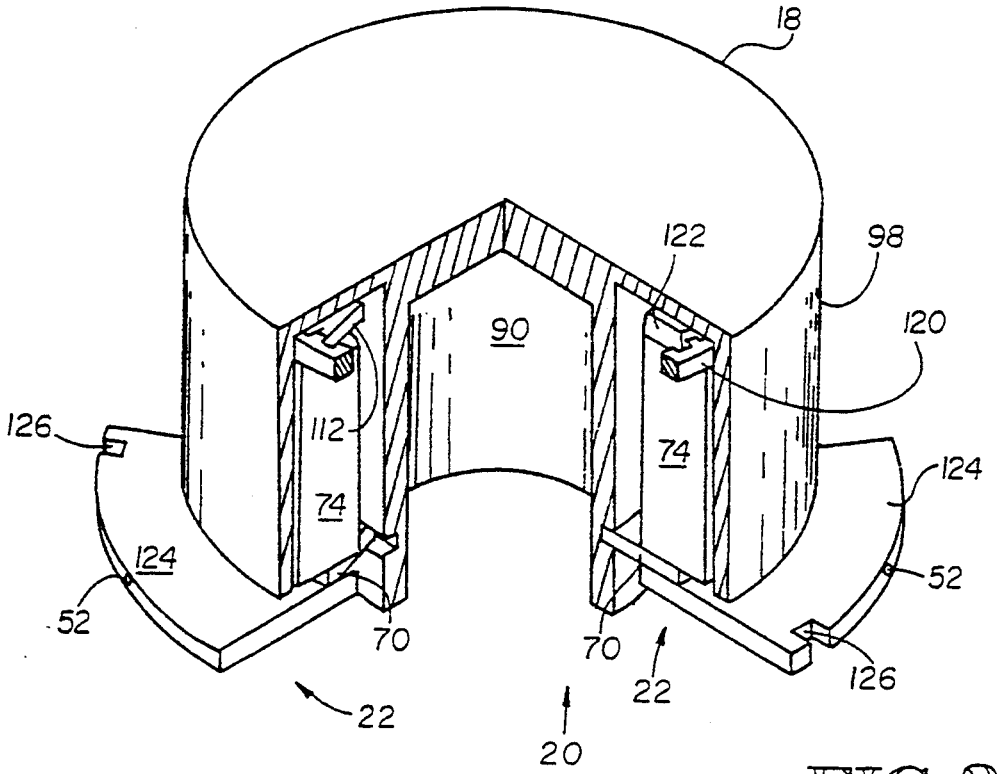
FIG. 3

FIG. 7
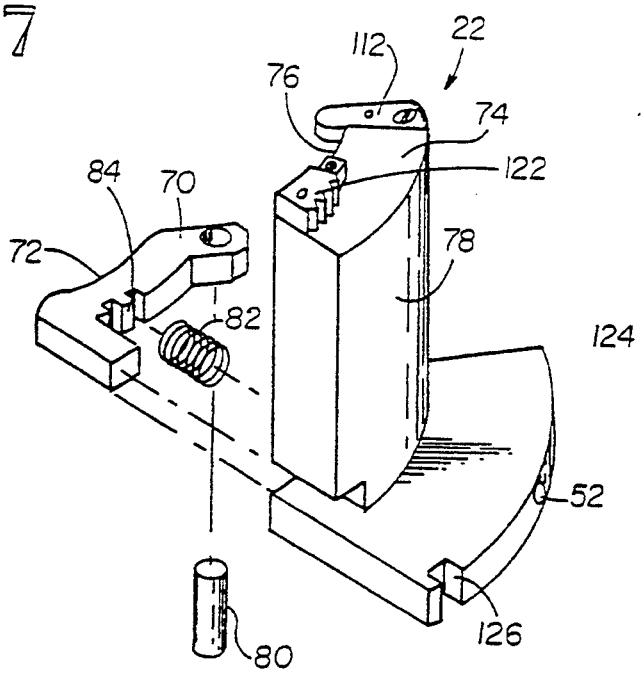
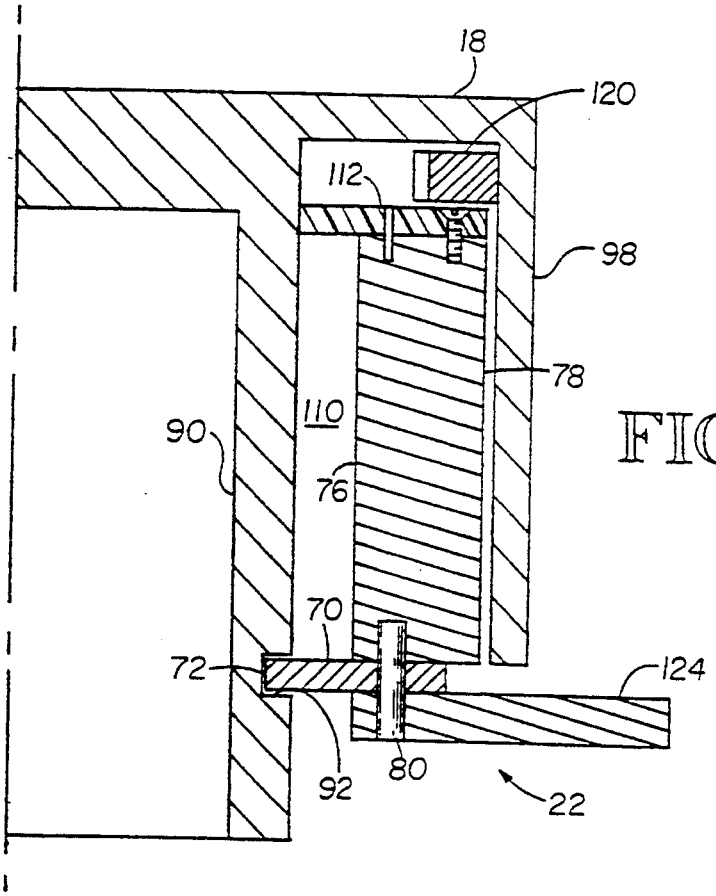
FIG. 8

SELF-BALANCING APPARATUS AND METHOD FOR A CENTRIFUGE DEVICE

Cross-Reference to Related Application

This application is a division of U.S. patent application Ser. No. 07/645,106, filed Jan. 23, 1991, now U.S. Pat. No. 5,207,634.

TECHNICAL FIELD

The invention relates to methods and apparatus for balancing a rotating device. More specifically, the invention relates to methods and apparatus for self balancing a centrifuge rotor or platter which is adapted to receive one or more assay cartridges.

BACKGROUND OF THE INVENTION

Automated patient sample analysis devices have been developed to run various tests or "assays" for the detection of various biological substances and determination of various biological quantities. Fully-automated apparatus of this type typically employ a rotor or platter for receiving one or more cassettes or cartridges containing the necessary chemical reagents for analyzing a patient's sample, typically human blood, blood plasma, or blood serum. It is often necessary to separate whole blood cells from their blood plasma or serum medium so that subsequent reaction of the plasma with various reagents can proceed. Such a separation step often involves spinning a platter or rotor at a high speed, up to 10,000 RPM, to achieve the desired centrifugal force which separates the whole blood cells from the blood plasma. After such separation has been achieved, the plasma may then react with various reagents to produce, for example, conjugates having optically detectable labels or labels detectable by other means. Detection and quantification of the labels are thus indicative of a biological quantity to be recorded.

Often, incubation and agitation of the separated plasma with the suitable reagents are necessary steps in performing the assay. Precise control of assay cartridge temperature, agitation magnitude, and agitation time may be necessary to achieve repeatable assay results. It is therefore highly desirable to control the degree of agitation to which such cartridges or cassettes are subject to provide consistent test results. It is also desirable for purposes of efficiency to process one or more cartridges, each containing samples from different patients, simultaneously. Assuming that the rotor itself is balanced about its rotation axis, and further assuming that receptacles for the cartridges are positioned at regular angular intervals about the rotation axis, the rotor will remain dynamically balanced as long as a cartridge is received in each cartridge receptacle on the rotor, or as long as multiple cartridges are distributed symmetrically around the rotor. However, in a clinical setting it may be desirable to operate the analysis instruments with less than a full load of cartridges for the rotor. In this case, the rotor will not remain balanced unless "dummy" cartridges are inserted into the empty receptacles of the rotor, or when the cartridges are symmetrically distributed by the instrument operator, which may be impossible due to the fixed spatial relationship of the cartridge receptacles. In the absence of providing "dummy" cartridges or some other means for balancing the rotor, undesirable vibrations can develop which may interfere with the performance of the assays. For example, consider a rotor having a plurality of receptacles for assay cassettes, and further assume that each cassette weights approximately 10 g when loaded with the appropriate reagents and patient sample. Assume further that the center of mass of the cassette is positioned 9 cm from the rotation axis. At 5,000 RPM, the radial force exerted by the cassette on the rotor is approximately 55 lbs. If this force is not balanced by a counterforce, vibrations may develop which will undesirably agitate the received cassettes in an uncontrolled and unanticipated manner. In addition, the vibrations may detrimentally effect the structural integrity of the analysis device.

To overcome the above-described difficulties, at least one automated patient sample instrument manufacturer has introduced a passive system for counterbalancing a rotor having a plurality of cassette receptacles. As described in *Clinical Chemistry*31(9), 1985, a two-dimensional centrifugation system for desktop clinical chemistry is described which employs a rotor having a plurality of receptacles for assay cassettes. The receptacles are positioned at the periphery of a rotor at regularly spaced angular intervals. Associated with each receptacle is a weight which slides on a radially-directed track. The weight is biased to move inwardly towards the center of rotation when the rotor is not rotated. At high rotational speeds, the weights move radially outward under centrifugal force to provide a larger centrifugal force on the rotor than at times when the weight is positioned radially inward. When a cassette is received in a cassette receptacle, a mechanism prevents the weight from sliding outwardly. Although this device suitably suppresses undesirable vibrations in the apparatus by counterbalancing the rotor, this device requires that a sliding weight, spring bias mechanism, and associated locking device be provided for each receptacle of the rotor. Such a system is expensive to manufacture and undesirably reduces the reliability of the counterbalancing technique because each of the counterbalancing devices for each cassette receptacle must operate properly for the rotor to be counterbalanced.

Various techniques are known for balancing shafts on high speed rotating equipment. These techniques often involve the rotational movement of two or more lopsided or elliptical cams with respect to the shaft rotation axis in response to vibrations developed in the shaft. Such devices typically employ a vibration sensor which detects the magnitude of shaft vibrations. The cams are then rotated until the vibrations subside. Such a system is inapplicable to a patient sample testing instrument described above because it is necessary to prevent undesirable vibrations before they occur to ensure that the assay cassettes do not receive any agitation in addition to the programmed agitation which may be provided by the test instrument.

Therefore, a need exists for a self-balancing apparatus for a rotating centrifuge which utilizes a minimum number of moving parts, which is relatively inexpensive to manufacture, and which balances the rotor prior to high speed centrifugation of the cassettes.

SUMMARY OF THE INVENTION

It is an object of the present invention to provide a self-balancing apparatus for a rotor on an analytic instrument which automatically balances the rotor regardless of the number or location of assay cassettes which are received in the rotor.

It is another object of the present invention to achieve the above object with a device which has a minimum number of moving parts and which is relatively simple to manufacture.

It is yet another object of the present invention to provide a method for balancing a rotor which balances the rotor without requiring high speed rotation thereof, which would undesirably affect performance of the assays in the assay cassettes.

The present invention achieves these objects, and other objects and advantages which will become apparent from the description which follows, by providing a self-balancing apparatus and technique which employs two arcuately movable counterweights which can be connected to the rotor or platter which is adapted to receive a plurality of assay cassettes or cartridges. The device determines the number and positions of cartridges which have been received in the rotor or platter. A desired position for the counterweights with respect to the platter or rotor is then calculated and the counterweights are moved with respect to the platter to the desired, counterbalancing positions. The rotor is then prepared to rotate at desired speeds for performing the assays of interest.

In its preferred embodiment, the self-balancing apparatus has two counterweights of substantially equal mass which are adapted for arcuate movement with respect to the rotor. The counterweights are provided with engagement/disengagement mechanisms which alternately engage and disengage the counterweights with respect to a frame member and with respect to the rotor. When the counterweights are engaged to the frame, and disengaged from the rotor, movement of the rotor with respect to the frame repositions the counterweights with respect to the rotor. Once the counterweights have been repositioned at their desired, counterbalancing position, the counterweights are re-engaged with the rotor and disengaged from the frame. The rotor is then counterbalanced and prepared for rotation at high speeds.

To determine the desired counterbalancing position of the counterweights, the apparatus first determines the number and position of assay cassettes loaded into the rotor. Desired angular positions for each of the counterweights relative to the locations of the received cartridges are then calculated, and the counterweights are moved with respect to the rotor to the desired angular positions. The rotor is thus counterbalanced for subsequent rotation of the same at a desired speed for centrifuging and processing the cartridges without undesirable vibrations.

BRIEF DESCRIPTION OF THE DRAWINGS

FIG. 1 is an isometric view of a patient sample analysis instrument having a rotor for receiving a plurality of assay cartridges.

FIG. 3 is a partial isometric view of the rotor hub.

FIG. 7 is an isometric, exploded view of a counterweight of the invention.

FIG. 8 is a partial, sectional, side elevational view of the rotor hub taken along line 8—8 of FIG. 6.

DETAILED DESCRIPTION OF THE INVENTION

Figure 2:
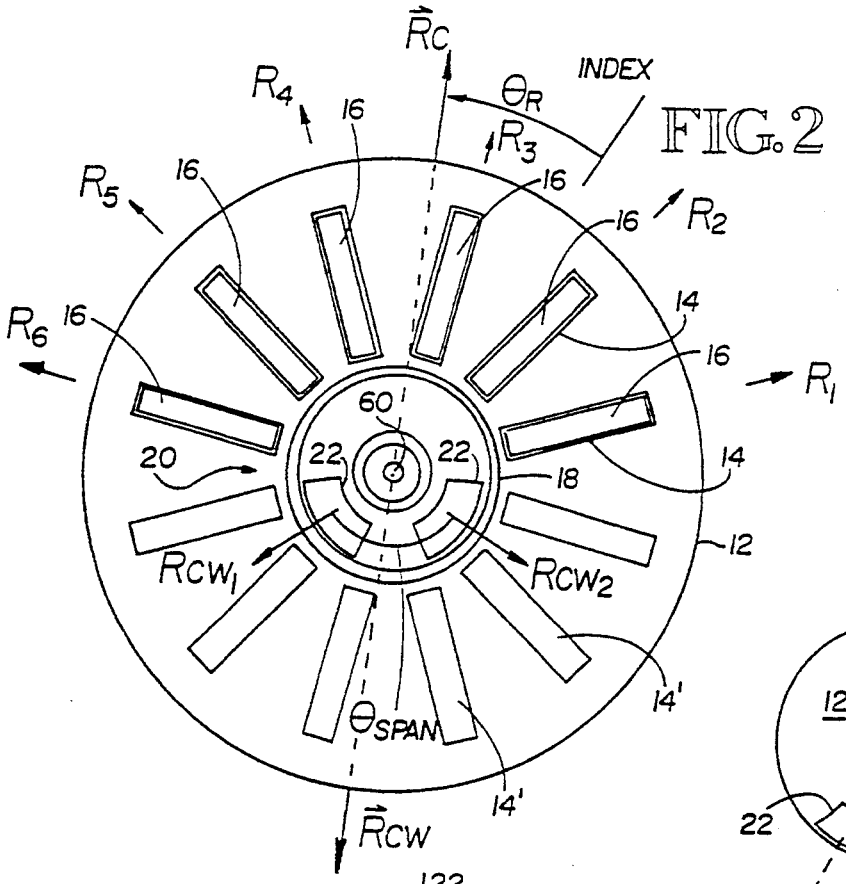
FIG. 2 is a top plan view of the rotors shown in FIG. 1.

An automated patient sample analysis instrument employing a self-balancing apparatus and method of the present invention, is generally indicated at reference numeral 10 of FIG. 1. The instrument is adapted to perform fully-automated processing of a variety of assay cartridges or cassettes, such as those described in copending U.S. patent application Ser. No. 07/387,917 entitled "Biological Assay Cassette and Method for Making Same," assigned to the assignee of the present invention and filed on Jul. 31, 1989, the disclosure of which is incorporated herein by reference. For the purposes of this disclosure it is sufficient to understand that the cassettes incorporate a fully self-contained chemical and biological system for performing an assay involving a patient sample such as blood, blood plasma, or blood serum. The patient sample is introduced at one end of the cartridge, then centrifuged to promote movement of the sample through various axially-directed chambers or layers in the reaction cassette until a complete reaction has occurred at a bottom end of the cassette. This bottom end of the cassette is then photometrically analyzed to determine a relevant quantitative measurement indicative of a biological reaction. It is to be understood that the analysis instrument itself is capable of processing assay cartridges of various different types which may be presently available or which may be developed in the future.

The automated patient sample analysis instrument 10 is substantially similar to the device described in copending U.S. patent application Ser. No. 07/387,910 filed Jul. 31, 1989 entitled "Method and Apparatus for Measuring Specific Binding Assays," assigned to the assignee of the present invention, the disclosure of which is incorporated herein by reference. Generally speaking, the instrument is provided with a rotating platter or rotor 12 having a plurality of assay cassette receptacles 14 for receiving the assay cassettes described above. The apparatus is provided with control mechanisms generally shown in FIG. 9 for reading the cassettes, centrifuging the cassettes, incubating the cassettes, and agitating the cassettes to perform the desired assays within the cartridges under controlled conditions. The rotor is preferably provided with 16 such receptacles, but may be provided with 12 receptacles as shown in FIG. 2, or more or less receptacles as desired.

As previously stated, the assay cartridges are processed by a technique employing centrifugal force, incubation, and agitation under controlled conditions of magnitude and duration. One aspect of providing a suitable instrument for this purpose involves minimizing undesirable, inconsistent vibrations which may otherwise be transferred to the cassettes due to an imbalance in the rotor 12 when loaded with a non-symmetrical distribution of cassettes. FIG. 2 illustrates such a situation where cassettes 16 have been loaded into six adjacent receptacles 14 while the remaining six adjacent receptacles 14' are unloaded. This maldistribution causes a substantial dynamic imbalance in the rotor, which may spin at speeds up to 10,000 RPM for certain assays. As an example of the imbalanced forces which can be generated on the rotor 12, consider a single cassette having a mass of approximately 10 g with the center of mass positioned 9 cm from the rotor center. At 5,000 RPM, the radial force exerted by this cassette on the rotor is 55 lbs. The total imbalance caused by six cassettes, as shown in FIG. 2, is substantially greater.

In order to compensate for the potential imbalances caused by a non-symmetrical distribution of cassettes received in cassette receptacles 14, the rotor 12 is provided with a counterweight mechanism generally indicated at reference numeral 20 in FIGS. 2 and 3.

The counterweight mechanism 20 includes two counterweights 22 which are arcuately movable with respect to the rotor 12. As is described further hereinbelow, the counterweights are alternately engageable and disengageable with the hub 18 of the rotor, and with the frame 17 of the analysis instrument 10. To move the counterweights 22 towards desired, individual counterbalancing positions, a counterbalancing position for each counterweight 22 is calculated according to the number and position of cassettes 16 received in cassette receptacles 14'. The counterweights 22 are then individually disengaged from rotor 12, as will be described further hereinbelow, and are engaged with the frame. The rotor 12 is then rotated, as described further hereinbelow to a relative position with respect to the counterweight such that the counterweight is positioned in the desired counterbalancing position. The counterweight is then disengaged from the frame 17 of the instrument 10 and re-engaged with the rotor 12. This procedure is also followed for the second counterweight. The instrument is then ready to process the received cassettes 16 at high rotational speeds without any significant imbalance of the rotor imparting undesired vibrations to the cassettes or to the supporting structure, bearings, etc. of the instrument.

Figure 9:
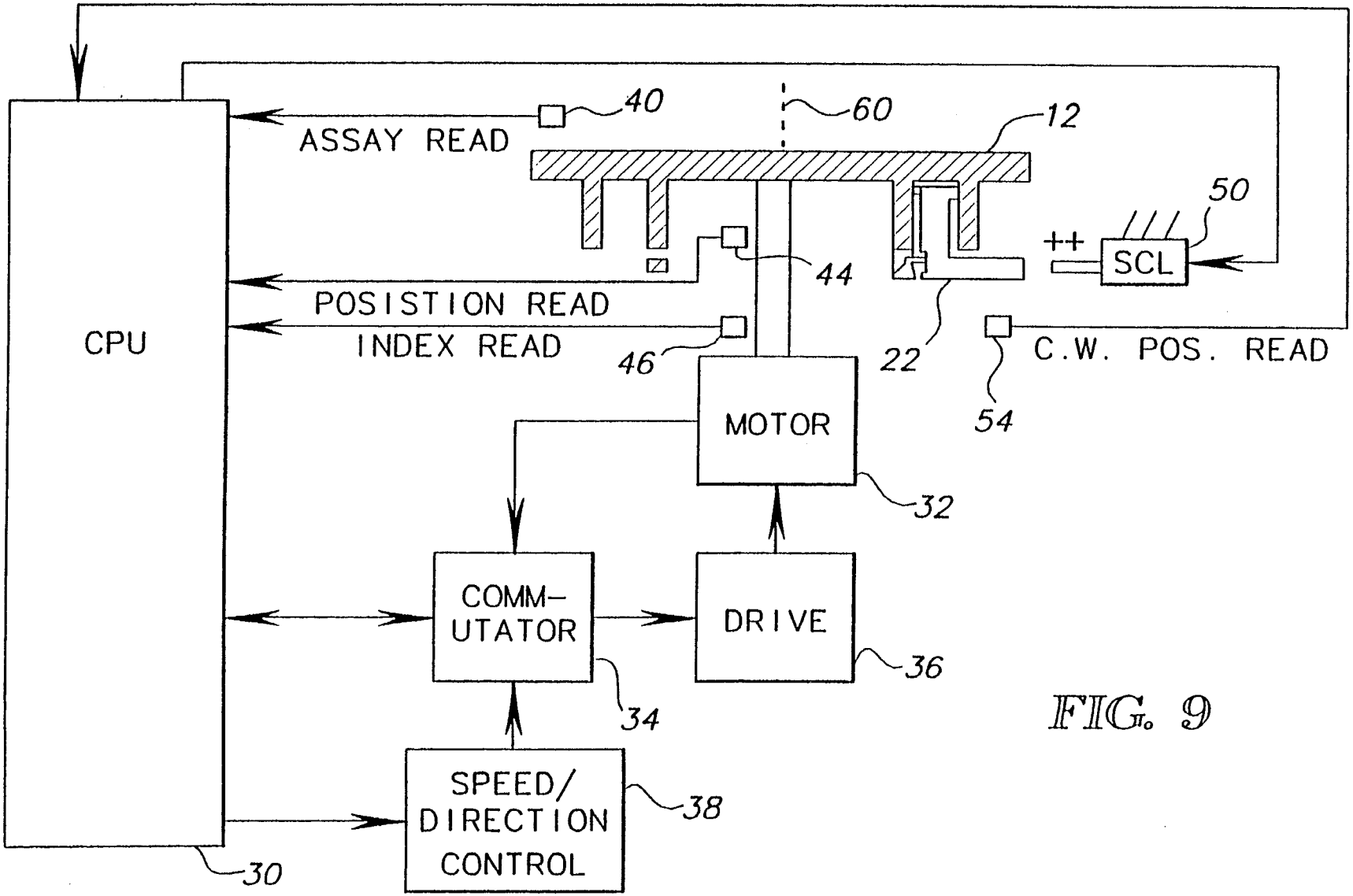
FIG. 9 is a schematic diagram of a control system for a rotor drive mechanism and a counterweight movement mechanism.

As shown in FIG. 9, the instrument 10 is provided with a control system including a microprocessor 30 which is programmed to operate the instrument as described hereinbelow. A suitable microprocessor is a Zilog model Z-180 manufactured by Zilog, Inc., of Campbell, California. The rotor 12 is driven by a motor, such as a 3-pole brushless direct current motor 32. The microprocessor 30 controls the motor through a conventional commutator 34 and associated drive circuit 36. A speed control circuit 38 utilizes pulse width modulation to control the speed of the motor under direction from the microprocessor 30.

The speed of the rotor 12 is programmed to vary from a low speed for reading data encoded on the cassettes to a high speed of up to 10,000 RPM for centrifuging. The cassette data may be encoded on the cassette cartridges 16 such as by a bar code. The bar code on the cartridges is read by an optical detector/emittor pair of the conventional type indicated at reference numeral 40. The microprocessor is also programmed to rotate the rotor at a very low speed to incubate and agitate cartridges received in the rotor. Agitation is achieved by modulating the speed and direction of the rotor through the drive circuit 36.

The position and speed of the rotor 12 is monitored by a second emittor/detector pair 44 positioned on the motor 32. A third emittor/detector pair 46 on the motor serves as an index locator to determine a "12 o'clock" or index position for the rotor 12. All of the emittor/detector pairs are operatively coupled to the microprocessor 30. A suitable encoder incorporating the second and third emittor/detector pairs is available from Hewlett-Packard, Corp., Palo Alto, Calif. As is apparent from the above, and from the schematic shown in FIG. 9, the position of the rotor 12, the number and position of cassettes received in the cassette receptacles 14, and the direction of rotation of the rotor 12 are known by the microprocessor 30. In order to appropriately position the counterweights 22 with respect to the rotor 12, the positions of the counterweights must at some point be known so that the appropriate relative positioning of the counterweights and rotor can be achieved. For this purpose, the instrument 10 is provided with a solenoid 50 shown in FIGS. 4–6 and 9, which is operated by the microprocessor 30. The solenoid is fixed to the frame 17 of the instrument. The solenoid has the ability, as is described hereinbelow, to decouple the counterweights 22 from the rotor 12 and fix the position of the counterweights at the location of the solenoid 50 with respect to the frame.

In order to determine when the counterweights 22 are in a position so as to be capturable by the solenoid 50, the counterweights are provided with an embedded magnet 52. The magnet 52 actuates a Hall effect sensor 54 so as to inform the microprocessor 30 when a counterweight 22 is in the capturable position. The located counterweight 22 is then fixed with respect to the frame 17 by activation of the microprocessor-controlled solenoid 50 and the rotor 12 is rotated under microprocessor control until the counterweight is positioned in the desired, counterbalancing position with respect to the rotor. At that time, the microprocessor 30 instructs the solenoid 50 to release the counterweight, allowing the counterweight to re-engage the rotor for rotation therewith. This process is repeated with the second counterweight until both counterweights are in the desired, counterbalancing positions in accordance with the calculations performed by the microprocessor.

The method for calculating the desired, counterbalancing positions for the counterweights is described as follows. As stated above, the microprocessor 30 first reads the number and relative positions of the cassettes 16 received in the cassette receptacles 14 of the rotor 12. A bar code on the cassette advises the microprocessor of the type of assay in the cassette. The microprocessor has in its memory information relating to the mass of that particular cassette type and the center of mass distance of that particular cassette type from the rotation axis of the rotor. The microprocessor then knows the approximate mass (usually in the range of 10 g to 15 g) of the cassettes and calculates a resultant mass-moment vector for all of the cassettes. This vector is directed radially outwards from the center of the rotor and has a magnitude equal to the product of the center of mass distance of the cassettes when received in the cassette receptacles from the rotation axis 60 of the rotor and the mass of the cassette. The microprocessor calculates the magnitude of the resultant mass-moment vector by summing the orthogonal magnitude components of each cassette. Specifically, one set of components is equal to the sum of the mass of each cassette times the cosine of the angle its individual mass-moment vector forms with the index position (i.e., 12 o'clock) of the rotor. The transverse mass-moment component of each cassette mass-moment vector is equal to the mass of the cassette multiplied by the sine of its angle with respect to the index position. The angle of the resultant vector is merely the arc tangent of the ratio between the orthogonal components of the individual mass-moment vectors of each cassette as described below:

$$R_{cx} = \sum_{\text{all cassettes}} M_c \cos \theta_c \quad (1)$$

$$R_{cy} = \sum_{\text{all cassettes}} M_c \sin \theta_b$$

where $R_{cx}$ and $R_{cy}$ are the magnitudes of the transverse components of the individual mass-moment vectors; $M_c$ is the product of a cassette mass and its center of mass distance from the rotation axis 60; and $$\theta_R = \tan^{-1}(R_{cy}/R_{cx}), \quad (2)$$

where $\theta_R$ is the angular position of the cassette resultant mass-moment vector measured with respect to an index position.

Figure 2A:
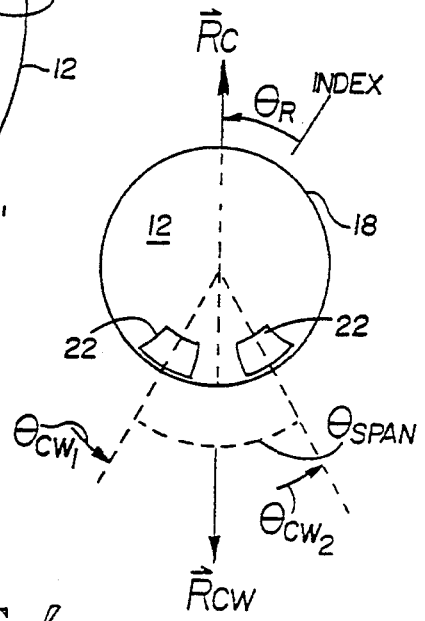
FIG. 2*a* is a free body diagram illustrating various vector components associated with calculating desired, counterbalancing positions for counterweights of the invention.
Figure 4:
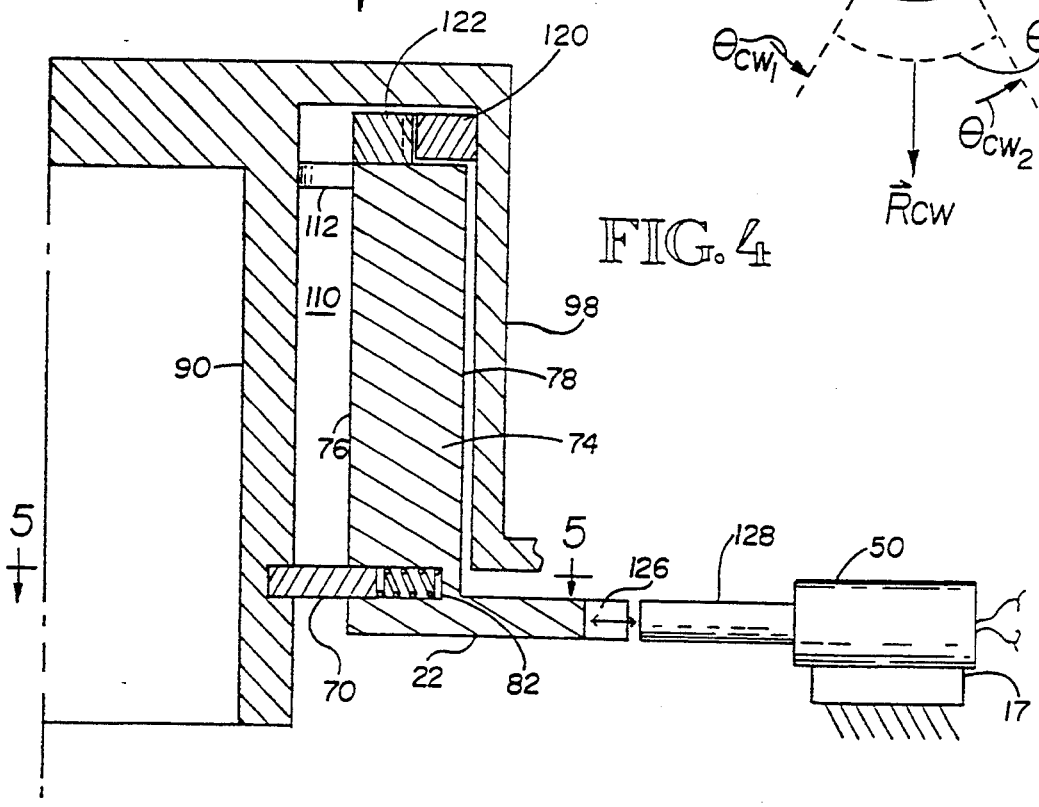
FIG. 4 is a partial, sectional side elevational view of the rotor hub taken along the lines 4—4 of FIG. 5.

As best understood by reference to FIGS. 2 and 2a, the counterweights 22 are moved arcuately with respect to the rotor 12 within the hub 18 as described above, so that a bisector of their respective radial mass-moment vectors is diametrically opposed to the position of the cassette resultant mass-moment vector $R_c$. The mass of the counterweights is known (approximately 146 g each) as is their radial center of mass distance from the rotation axis 60 of the rotor 12 (approximately 2.9 cm). To determine the desired, counterbalancing positions of each counterweight, it should be remembered that one component of each of the counterweight, mass-moment vectors will cancel its mirror image with respect to the remaining counterweight because the counterweights are always moved, with respect to the rotors, an equal arcuate distance away from the desired, resultant counterweight mass-moment vector which is diametrically opposed to the resultant cassette mass-moment vector. If the radial distance between the center of masses of each counterweight is defined as $\theta_{span}$ (see FIG. 2), then the magnitude of the resultant mass-moment vector contributed by both counterweights is twice the mass of each counterweight multiplied by the cosine of ($\frac{1}{2}\theta_{span}$) as stated below:

$$R_{cw} = 2M_{cw} \cos (\theta_{span}/2) \quad (3)$$

where $R_{cw}$ equals the magnitude of the resultant moment from the non-cancelling component of each counterweight, and where $M_{cw}$ equals the mass of each counterweight times its center of mass distance from the rotation axis of the rotor. Then $$\theta_{span} = 2 \cos^{-1}(R_{cw}/2M_{cw}),$$

and;

$$\theta_{cw1} = \theta_R + 180° - \tfrac{1}{2}\theta_{span}$$

$$\theta_{cw2} = \theta_R + 180° + \tfrac{1}{2}\theta_{span}, \quad (4)$$

where $\theta_{cw1}$ equals the desired radial position of the first counterweight with respect to the index position and where $\theta_{cw2}$ equals the desired, counterbalancing position of the second counterweight 22.

The specific structure of the counterweights 22 and the mechanisms by which they are engageable and disengageable with respect to the rotor 12 are best understood with reference to FIGS. 3–8. As shown in FIG. 8, each counterweight 22 has an inner portion 70 having an arcuate inner surface 72 and an outer portion 74 having an arcuate inner surface 76 and an arcuate outer surface 78. The inner portion 70 and outer portion 74 are pivotally connected together by a pin 80. A coil spring 82 is compressed between a receiving seat 84 on the inner portion 70 and a corresponding receiving seat 86 on the outer portion so as to bias the inner and outer portions away from one another.

As shown in FIG. 8, the rotor hub 18 has an inner, downwardly directed cylindrical flange 90 defining an outwardly directed circumferential groove 92 for receiving the arcuate inner surface 72 of the inner portion 70 of the counterweight 22. The groove is sized so as to be slightly larger than the inner portion 70 so as to slidingly receive the same. The hub 18 also has an outer, downwardly directed cylindrical flange 98 which is spaced radially outward from the inner flange 90 so as to define an open-ended annular cavity 110 for receiving the outer portion 74 of the counterweight 22. The outer portion 74 of the counterweight has a thickness between its arcuate inner and outer surfaces 76, 78 which is less than the radial dimension of the annular cavity 110 so that the counterweight 22 can move circumferentially within the annular cavity. The counterweight is vertically supported by the inner portion 70 which rides in the circumferential groove 92. The upper end of the outer portion 74 is provided with a plastic guide member 112 having a length which is substantially equal to the radial dimension of the annular cavity 110 to laterally support and guide the counterweight 22 within the annular cavity.

Figure 5:
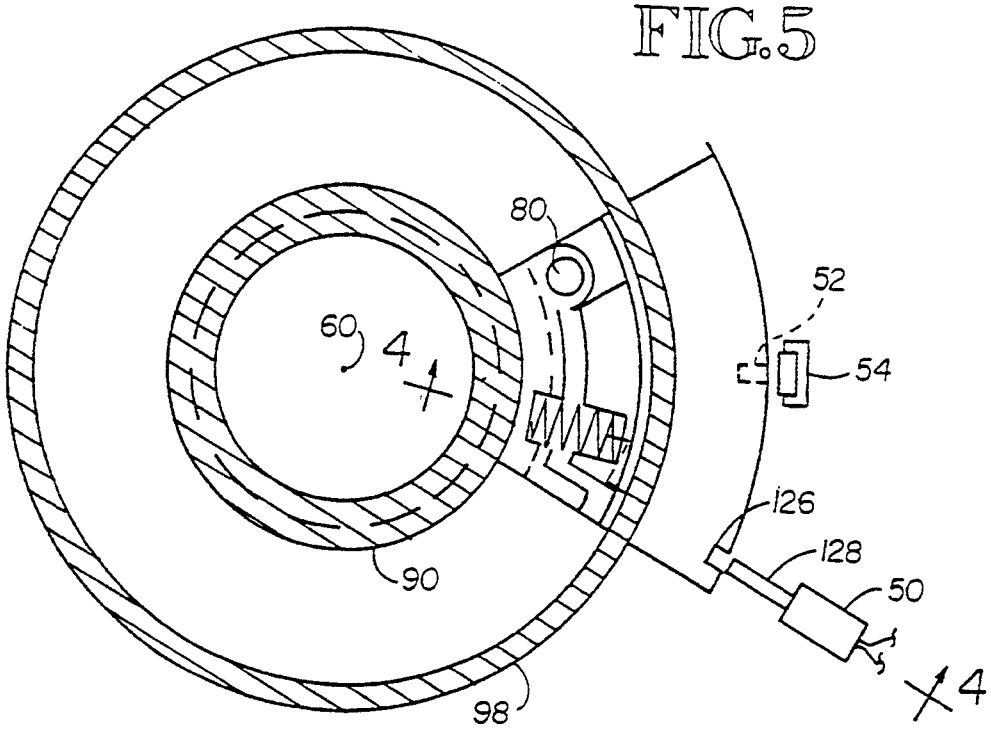
FIG. 5 is a sectional, top view of the rotor hub taken along line 5—5 of FIG. 4 with one of the counterweights shown in an engaged position with the rotor hub.
Figure 6:
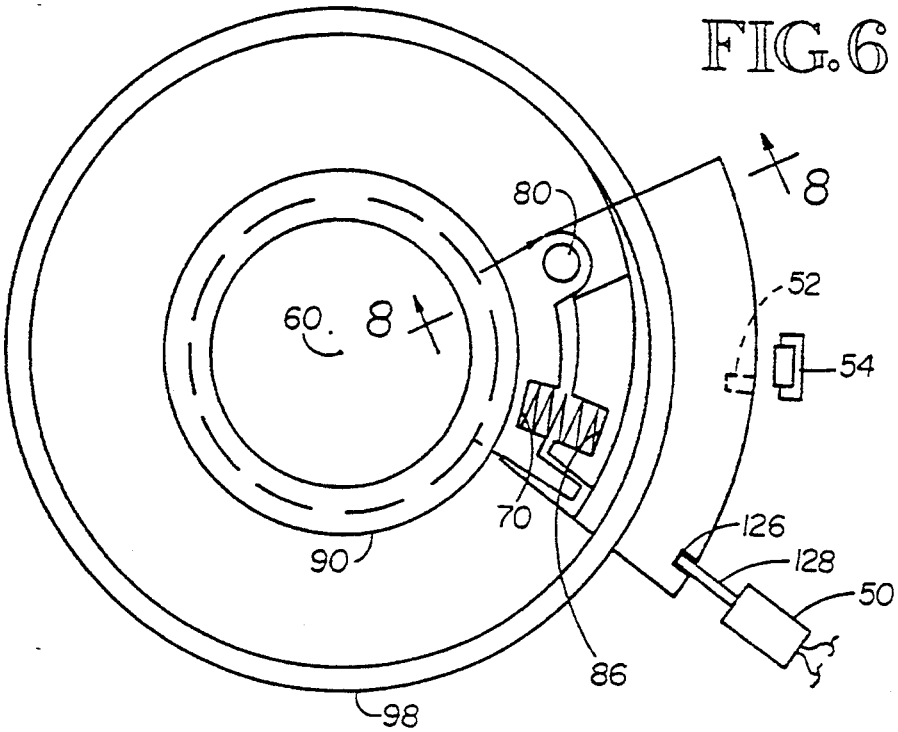
FIG. 6 is a sectional, top view similar to FIG. 5 showing one of the counterweights in a disengaged position from the rotor hub.

The outer flange 98 also has an inwardly directed toothed ring 120 which is mateable with a toothed surface 122 cooperatively positioned on the top of the outer portion 74 of the counterweight 22. As best seen in FIG. 5, when the inner and outer portions 70, 74 of the counterweight are biased away from one another, the toothed surface 122 cooperatively engages the toothed ring 120 on the outer flange so that the counterweight 22 engages the rotor 12. It is apparent that at high rotational speeds, the engagement is enhanced and does not require the bias caused by spring 82 to maintain the engagement. However, when it is desired to change the relative positions of one or more of the counterweights with respect to the rotor hub 18, the solenoid 50 under instruction from the microprocessor 30 causes the outer portion 74 to pivot inwardly about pin 80 with respect to the inner portion 70 of the counterweight 22 so as to disengage the counterweight from rotation with the hub 18 while simultaneously engaging the counterweight 22 with the frame 17 of the instrument. The microprocessor is then free to cause the rotor 12 to rotate with respect to the counterweight 22 until the desired relative position of the counterweight with respect to the rotor is achieved. To encourage engagement of the solenoid with the counterweight 22, the outer portion 74 of the counterweight is provided with a radially-extending lip 124 at its lower end thereof which extends outwardly from the outer, downwardly directed circular flange 98. The lip 124 is provided with a pocket 126 for receiving a plunger 128 of the solenoid 50. The microprocessor knows when the plunger 128 is in position to register with the pocket 126 due to a signal from the sensor 54 which detects the presence of magnet 52 when it is opposite the sensor.

Each of the counterweights is moved individually by cooperative action of the solenoid 50 and angular motion of the rotor 12 under control of the microprocessor as described above.

After an assay run has been completed with one or more assay cassettes received in the cassette receptacles 14, the operator can remove the cassettes therefrom and load the instrument 10 with a new batch of cassettes. The instrument 10 will then repeat the process of: 1) spinning the rotor 12 slowly to determine the location and number of received cassettes; 2) calculating the new desired counterbalancing position for the counterweights 22; 3) rotating the rotor 12 until the sensor 54 locates one of the counterweights; 4) locating the captured counterweight with the sensor 54; 5) disengaging the counterweight from the hub 18 by actuating the solenoid 50; 6) moving the rotor with respect to the counterweight 22 while the counterweight is disengaged therefrom; and 7) releasing the counterweight by de-energizing the solenoid 50 to re-engage the counterweight with the hub 18. This process is then repeated for the other counterweight until both counterweights 22 are in their new, desired counterbalancing positions, at which time the centrifugal processing of the cassettes at high rotational speeds can proceed.

Other variations and embodiments of the invention are contemplated. For example, the specific frictional engagement mechanism of the counterweights with the rotor may be modified to a technique other than the use of toothed surfaces as will be apparent to those of ordinary skill in the art. In addition, the specific shape of the counterweights may be varied from that shown in the drawings. Therefore, the invention is not to be limited by the above description, but is to be determined in scope by the claims which follow.

I claim:

1. A method for balancing a centrifuge adapted for receiving one or more assay cassettes, comprising the following steps:

providing a rotatable platter having receptacles for a plurality of the assay cassettes and providing two counterweights which are coupleable to the platter;

loading one or more assay cassettes into the platter receptacles;

determining the number and location of the loaded assay cassettes;

determining the resultant force that will be applied to the platter by the received assay cassettes;

calculating desired angular positions for each of the counterweights so that the force applied to the platter by the counterweights will balance the resultant force applied by the assay cassettes; and moving the counterweights and platter with respect to one another so that the counterweights assume the desired angular positions prior to rotating the platter at a desired speed for centrifuging the assay cassettes.

2. The method of claim 1 wherein the counterweights and platter are moved with respect to one another by decoupling the counterweights from the platter, fixing the position of the counterweights with respect to a frame member, rotating the platter until the desired angular positions of the counterweights are achieved, decoupling the counterweights from the frame member, and re-coupling the counterweights to the platter.

3. The method of claim 2, wherein the counterweights are moved individually.

4. The method as recited in claim 1 wherein the step of determining the resultant force that will be applied to the platter as a result of the number and location of the received assay cassettes comprises the substeps of:

determining the force that will be applied to the platter by each of the received assay cassettes; and combining the forces applied to the platter by each of the received assay cassettes to determine the resultant force that will be applied the platter by the received assay cassettes.

5. The method as recited in claim 1 wherein the assay cassettes include first assay cassette types and wherein the step of determining the resultant force that will be applied to the platter by each of the received assay cassettes comprises the substeps of:

storing information describing the first assay cassette types; and determining whether any of the received assay cassettes is a first assay cassette type and, if so, obtaining the stored information relating to the first assay cassette type to determine the force that will be applied to the platter by the first assay cassette type.

6. The method as recited in claim 5 wherein each first assay cassette type is associated with information, that identifies the cassette type, and wherein the step of determining whether any of the received assay cassettes is a first cassette type comprises the substeps of:

reading the information associated with each received assay cassette to determine whether each received assay cassette is a first or second cassette type.

7. The method as recited in claim 1 wherein the step of loading one or more assay cassettes into the platter receptacles comprises the substep of randomly loading one or more assay cassettes into the platter receptacles.

8. The method as recited in claim 1 wherein the counterweights have substantially the same mass, and wherein the step of moving the counterweights comprises the substeps of:

using a control mechanism to determine a desired angular center-of-mass position for each of the received assay cassettes based upon the determined number and location of the received assay cassettes;

using the control mechanism to determine a net center of mass position for all of the assay cassettes based upon the determined angular center-of-mass for each of the received assay cassettes; and moving the counterweights a substantially equal angular distance away from the net center-of-mass position.

9. The method as recited in claim 8 wherein the step of moving the counterweights comprises the substep of using the control mechanism to sequentially move each counterweight.

10. The method of claim 1 wherein the platter is positioned in a housing and is constructed to rotate relative to the housing, the steps of moving the counterweight comprises the substeps of:

decoupling the counterweights from the platter and fixing the position of the counterweights with respect to a frame member;

rotating the platter until the desired angular positions Of the counterweights are achieved; and decoupling the counterweights from the frame member and recoupling the counterweights to the platter.

11. A method for balancing a centrifuge adapted for receiving one or more assay cassettes comprising the steps of:

providing a rotatable platter having receptacles for a plurality of the assay cassettes and providing two counterweights that are coupleable to the platter;

loading one or more assay cassettes randomly into the platter receptacles;

determining the number and location of the loaded assay cassettes;

determining a desired angular position for each of the counterweights based upon the number and location of the received assay cassettes; and moving the counterweights and platter with respect to one another so that the counterweights assume the desired angular positions prior to rotating the platter at a desired speed for centrifuging the assay cassettes.

12. A method for balancing a centrifuge adapted for receiving one or more assay cassettes, wherein the centrifuge includes a control mechanism for balancing the centrifuge, said method comprising the steps of:

providing a rotatable platter having receptacles for a plurality of the assay cassettes and providing two counterweights that are coupleable to the platter;

loading one or more assay cassettes into the platter receptacles;

using the control mechanism to determine the number and location of the received assay cassettes;

using the control mechanism to calculate the desired angular position for each of the counterweights based upon the determined number and location of the received assay cassettes; and using the control mechanism to control the movement of the counterweights and platter with respect to one another so that the counterweights assume the desired angular positions prior to rotating the platter at a desired speed for centrifuging the assay cassettes.

13. The method as recited in claim 12 wherein the step of determining the desired angular positions for each of the counterweights based upon the determined number and location of the received assay cassettes comprises the substeps of:

determining a mass-moment vector that will be applied to the platter by each of the received assay cassettes; and combining the mass-moment vectors applied to the platter by each of the received assay cassettes to determine the resultant force that will be applied to the platter by the received assay cassettes.

14. The method as recited in claim 12 wherein the assay cassettes include first and second cassette types and wherein the step of determining the desired angular positions for each of the counterweights based upon the determined number and location of the received assay cassettes comprises the substeps of:

recording information describing the first and second cassette types in a manner readable by the control mechanism; and using the control mechanism to determine whether any of the received assay cassettes is a first cassette type and, if so, obtaining the recorded information describing the first cassette type to determine the mass-moment vector that will be applied to the platter by the first cassette type.

15. The method as recited in claim 12 wherein the step of loading one or more assay cassettes into the platter receptacles comprises the substep of randomly loading one or more assay cassettes into the platter receptacles.

* * * * *